US005388507A

United States Patent [19]

Bonnet

[11] Patent Number: 5,388,507

[45] Date of Patent: Feb. 14, 1995

[54] AUTOMATIC DETERMINATION PROCESS FOR COMMAND AND CONTROL OF A FORCED DRAINING BEFORE PRESSING FOR BATCH PRESSES

[75] Inventor: Jean Bonnet, Angers, France

[73] Assignee: Constructions Meca-Metalliques Chalonnaises SA, Chalonnes sur Loire, France

[21] Appl. No.: 198,272

[22] Filed: Feb. 18, 1994

[30] Foreign Application Priority Data

Feb. 23, 1993 [FR] France ..... 93 02201

[51] Int. Cl.[6] ..... B30B 9/22

[52] U.S. Cl. ..... 100/37; 99/495; 100/43; 100/99; 100/104; 100/116; 100/211; 426/231; 426/489

[58] Field of Search ..... 100/37, 43, 99, 104, 100/110, 116, 211; 99/495; 426/231, 489, 495

[56] References Cited

U.S. PATENT DOCUMENTS

| | | | |
|---|---|---|---|
| 3,169,873 | 2/1965 | Clark et al. | 426/489 X |
| 4,568,549 | 2/1986 | Melandri | 426/489 X |
| 5,207,154 | 5/1993 | Bonnet | 100/37 |

FOREIGN PATENT DOCUMENTS

| | | | |
|---|---|---|---|
| 2945254 | 5/1981 | Germany | 100/104 |
| 4040430 | 7/1991 | Germany | 100/37 |
| 55-88999 | 7/1980 | Japan | 100/37 |
| 124067 | 10/1959 | U.S.S.R. | 100/37 |

*Primary Examiner*—Stephen F. Gerrity
*Attorney, Agent, or Firm*—Edmund M. Jaskiewicz

[57] ABSTRACT

An automatic process in which after the press is filled and before starting a normal pressing cycle the flow rate of liquids is measured continuously without applying any pressing pressure. The tank is then rotated and the minimum and maximum values of the flow rates are determined and then compared respectively with predetermined values. Based upon this comparison and as a function of the results of the comparisons there is performed a preliminary pressurized draining of the materials to be pressed while at the same time the orifices for evacuation of the liquids are checked for possible clogging. These operations are repeated until the results of the comparisons no longer warrant a pressurized preliminary draining and subsequently initiating the normal pressing cycle.

8 Claims, 3 Drawing Sheets

Fig.1A
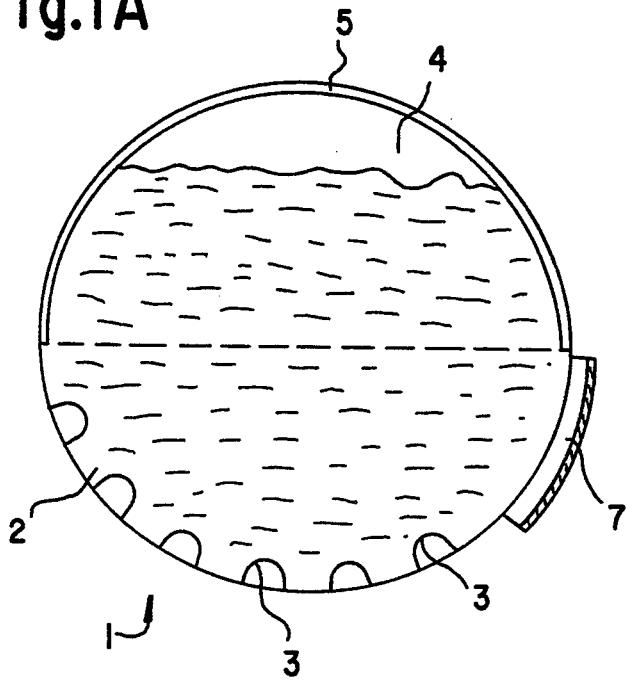
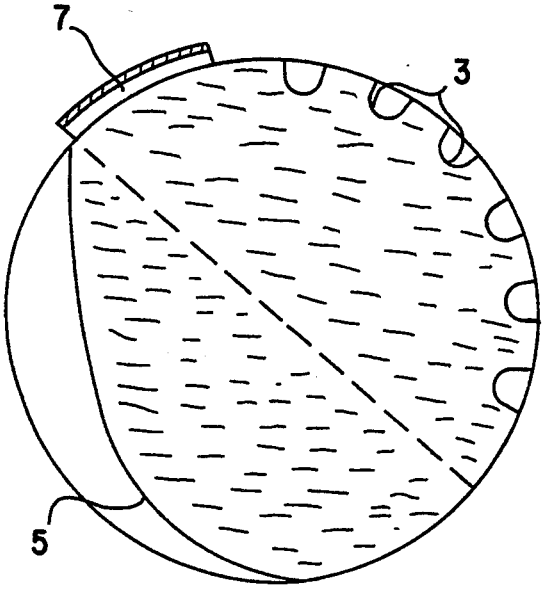
Fig.1C

AUTOMATIC DETERMINATION PROCESS FOR COMMAND AND CONTROL OF A FORCED DRAINING BEFORE PRESSING FOR BATCH PRESSES

BACKGROUND OF THE INVENTION

The present invention relates to the field of methods and processes for extraction of liquids or juices of materials to be pressed and for control of presses, including membrane presses, particularly to an automatic determination process for command and control of a preliminary pressurized or forced draining before pressing in batch presses.

FIELD OF THE INVENTION

Currently, the pressing of destemmed grape crops or of materials to be pressed that contain a great deal of free-run juices generally poses many problems, at the beginning of the pressing cycle, for the users of batch presses (membrane presses, plate presses, . . . ). "Free-run juices" are those juices which flow from the material to be pressed by virtue of the inherent pressing of the material upon itself or juices which flow because of the inherent qualities or characteristics of the material to be pressed. These are juices that are already present in the pressing tank prior to any pressure being exerted upon the material to be pressed by a pressing element of the press.

Among the most frequently encountered problems can be mentioned on the one hand, squirtings of juices, and on the other hand, blockages of juices, involving dangers of clogging of the draining elements, such as the orifices permitting the evacuation of liquids outside the tanks of the press.

These malfunctions, for the user, are reflected by considerable losses of time, by a necessity of monitoring the press and by difficulties in defining an automatic pressing cycle (a cycle that is variable as a function of the filling conditions).

These problems and malfunctions are due to the presence of large quantities of free-run juices in the press after it is filled, the evacuation of these juices being poorly controlled by the known automatic pressing processes.

The study of said harmful phenomena makes it possible to distinguish two main causes of malfunction of the presses when the pressed grape crop contains a great deal of free-run juices.

Actually, at the beginning of the pressing cycle, the air located between the mobile pressing element and the grape crop is trapped since it cannot pass through the liquids blocked in the press, or the mass of the materials to be pressed.

In addition, the pressure generated in the tank of the press by the displacement of the pressing element (membrane, for example) is transmitted, by the liquids, to the materials in contact with the orifices assuring the evacuation of the liquids or juices outside the press and thus causes the clogging of the latter.

SUMMARY OF THE INVENTION

The object of the present invention is to eliminate such drawbacks and disadvantages by preparing the materials to be pressed for a normal pressing cycle, such as, for example, the cycle described in French patent application No. 90-14488 filed on Nov. 16, 1990 in the name of the same applicant.

For this purpose, this invention has as its object an automatic determination process for command and control of a forced or preliminary pressurized draining before pressing for batch presses, characterized in that it consists, after filling of the press and before starting the normal pressing cycle, in measuring continuously the flow rate of the liquids without applying pressing pressure, in ascertaining the minimum value and maximum value of said flow rate, in particular when the tank of the press rotates, in then comparing these values respectively with predetermined quantities, then, as a function of the results of said comparisons, in performing, if necessary, a forced draining of the materials to be pressed, while simultaneously checking for the possible presence of a clogging of the orifices for evacuation of liquids, in repeating the preceding operations until the results of said comparisons no longer entail the performing of a forced draining and, finally, in starting the normal pressing cycle.

BRIEF DESCRIPTION OF THE DRAWING

The invention will be better understood as a result of the following description, which relates to a preferred embodiment, given by way of nonlimiting example, and explained with reference to the accompanying diagrammatic drawings, in which:

FIGS. 1A, 1B, 1C and 1D illustrate, by section views of a membrane press, the various phases of a forced draining according to the invention, and, FIG. 2 represents, on the same timing diagram, the curves of variation of the flow rate of the liquids and of the pressing pressure applied during a forced draining according to the invention.

DESCRIPTION OF THE PREFERRED EMBODIMENTS

Figure 1B:
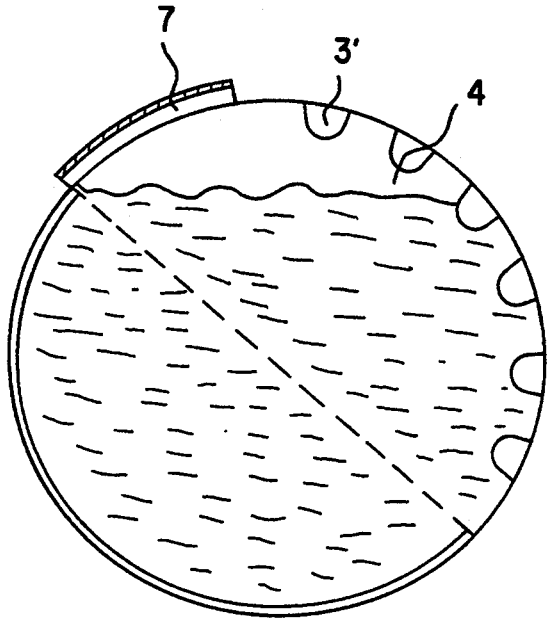
Figure 1D:
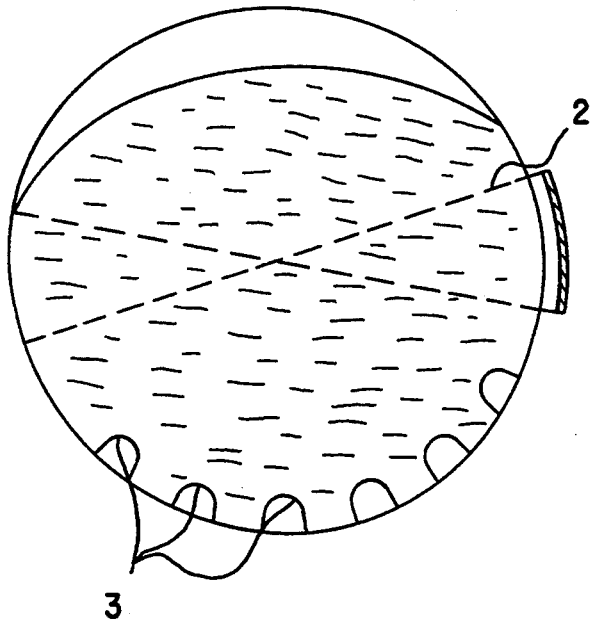
Figure 2:
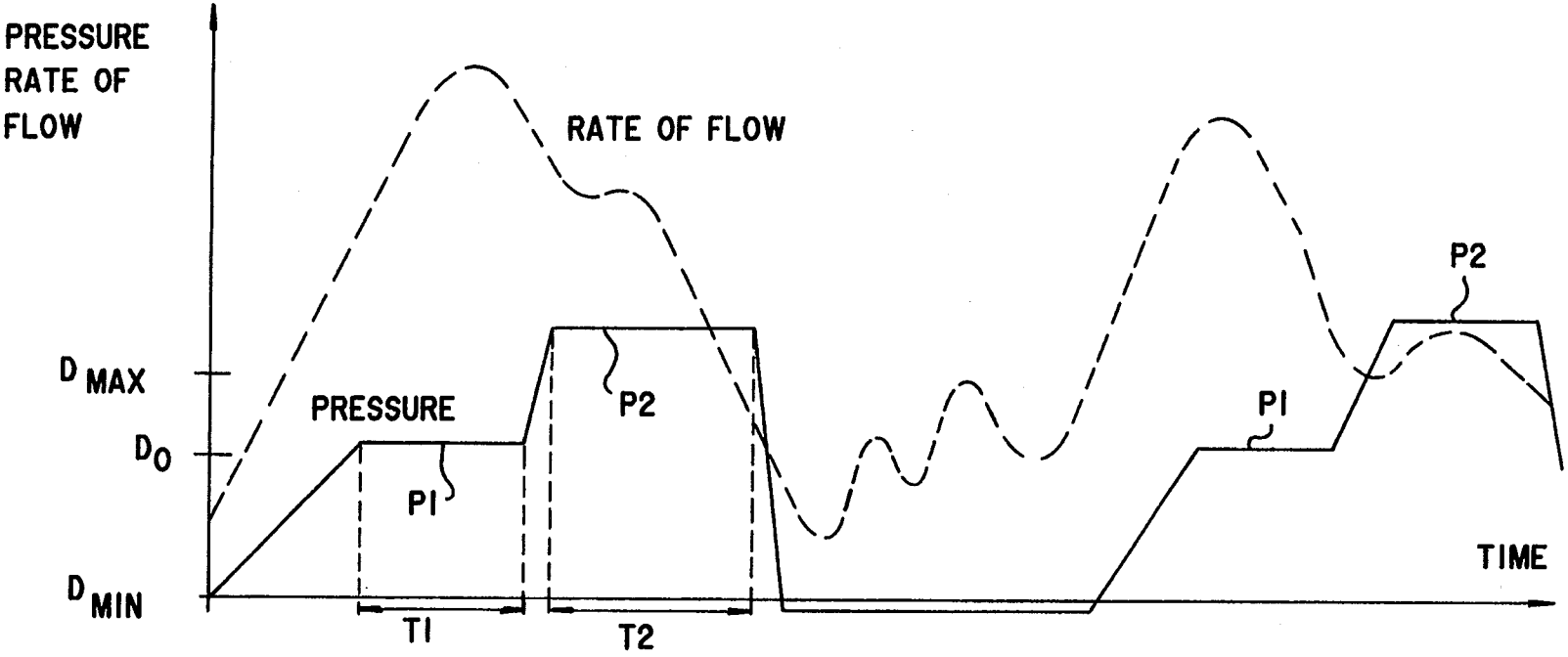

According to the invention, and as may be seen in FIGS. 1 and 2, the automatic determination process for command and control of a forced draining consists, after filling of press 1 and before starting normal pressing cycle C, in measuring continuously the flow rate D of the liquids without applying pressing pressure, in ascertaining the minimum value $D_{min}$ and the maximum value $D_{max}$ of said rate D, in particular when the tank of press 1 rotates, in then comparing these values $D_{min}$ and $D_{max}$ respectively with predetermined quantities $K_1 \times D_o$ and $K_2 \times D_o$, then, as a function of the results of said comparisons, in performing, if necessary, a forced draining of materials to be pressed 2, by simultaneously checking for the presence of a clogging of orifices 3 for evacuation of said liquids, in repeating the preceding operations until the results of said comparisons no longer entail the performing of a forced draining and, finally, in starting the normal pressing cycle C.

The latter can consist of one of the numerous pressing cycles known to a person skilled in the art, and, advantageously, of the one described in said French patent application No. 90-14488.

According to a first characteristic of the invention, a forced draining of materials to be pressed is performed only when at least one of the following conditions is verified:

$$D_{max} \geqq K_1 \times D_o \text{ or } D_{min} \geqq K_2 \times D_o,$$

where $K_1$ is a constant whose value is between 0.5 and 2, where $K_2$ is a constant whose value is between 0.05 and 0.4 and where $D_o$ is a flow rate value determined as a function of the size and the filling rate of the tank of press 1.

Of course, it is understood that if none of the above two conditions is verified, a normal pressing cycle C is immediately initiated.

For a membrane press, $D_o$ can advantageously be determined automatically as indicated in the above-mentioned patent application in the name of the applicant.

In regard to constants $K_1$ and $K_2$, they can preferably be equal respectively to 1 and 0.15.

As FIGS. 1A, 1B, 1C and 1D of the accompanying drawings show, by way of example relative to a membrane press, the forced draining of materials to be pressed 2 consists in causing, first of all, the removal of air 4 contained in the tank of the press 1, then in performing a controlled pressing at low pressure, followed by a decompression of said tank.

To be able to drive air 4 trapped between membrane 5, on the one hand, and materials to be pressed 2 and the free-run liquids or juices, on the other hand, the tank of press 1 is brought into a position that allows the removal of air 4 through a suitable opening, for example one of the drains 3' used to evacuate the liquids during the pressing phase (FIG. 1B).

Then, the pressing element, in this case membrane 5 (FIG. 1C), is displaced so as to raise materials to be pressed 2 in the tank in the direction of said drain 3', until all of the air is driven from this tank.

Consequently, air 4 contained in the tank of press 1 is driven outside tank 1 through orifices 3 and at least a drain 3' provided for the evacuation of liquids, the tank 1 being positioned so that the orifices 3 and the drain 3' are located in the upper part of the tank and air 4 then being driven by the raising of materials to be pressed 2 in the tank under the action of the pressing element.

This operation can, in the case of a membrane press 1, be perfectly controlled by controlling the pressure applied to said membrane 5, which is a function of the diameter of the tank of said press 1.

As soon as air 4 is completely driven from the tank of press 1, the latter is again placed in normal pressing position, corresponding to a maximum ability to evaluate the liquids or juices extracted and, a controlled pressing at low pressure is started.

This controlled pressing at low pressure for the forced draining consists, after removal of air 4 contained in the tank of press 1, in applying a first pressing pressure $P_1$ of low value, for a time $T_1$ determined as a function of the flow of the liquids, then in applying, if no clogging of orifices 3 for evacuation of the liquids has been detected during pressure level $P_1$, a second pressing pressure $P_2$, of greater intensity than $P_1$ and, then, in performing a decompression and, optionally, a mixing of materials to be pressed 2 after completion of pressure level $P_2$.

Pressures $P_1$ and $P_2$ can, by way of indication, have values respectively between 0.1 and 0.2 bar and between 0.2 and 0.5 bar.

Time $T_1$ can be calculated, during pressure level $P_1$, by analyzing the decrease in the flow rate of the liquids or juices extracted as described in the above-mentioned patent application in the name of the same applicant.

According to a characteristic of the invention, pressure level $P_2$ is maintained for at least a predetermined time $T_2$ and, if necessary, beyond the latter until flow rate D of the extracted liquids falls below a set-point value $D_2$, a function of $D_o$.

For a membrane press, the value of time $T_2$ can, advantageously, be between 1 minute and 5 minutes, while preferably being on the order of 2 minutes and the set-point value $D_2$ can be between $2\times D_o$ and $5\times D_o$, while preferably being on the order of $3\times D_o$.

The decompression after forced draining is accompanied by a mixing of materials to be pressed 2, in the form, for example, for a membrane press, of 1 to 5 complete rotations of the tank of press 1, and, preferably, of 2 rotations of this type.

It can also happen that excess pressures generated during the filling, by means of a pump for example, of the tank of press 1, may cause a clogging of the orifices that assure, in normal operation, the evacuation of liquids or juices.

Now, according to a feature of the invention, orifices 3 are considered as being clogged when, after application of the first pressure $P_1$ for a time $T_C$ during a forced draining, flow rate D of the extracted liquids is less than $D_o$, this while $D_{min} \geqq K_2\times D_o$ during the phase preceding the application of pressure $P_1$.

When said conditions are verified, therefore in the case of detection of a clogging, the process according to the invention can consist in prolonging the application of pressure $P_1$ for a predetermined time $T_P$, then in disengaging clogged orifices 3 by performing a vigorous mixing of materials to be pressed 2 after decompression.

By way of indication, time $T_C$ can be on the order of 10 seconds, time $T_P$ can be between 1 minute and 5 minutes (preferably 2 minutes) and, the number of rotation revolutions of the tank of press 1, for a membrane press, can be between 2 revolutions and 5 revolutions (preferably 3 revolutions).

During this decompression phase, the conditions leading to a forced draining are again controlled.

As a result of the invention, it is consequently possible to detect the necessity of a forced draining of the materials to be pressed, before the engaging of a normal pressing cycle C and to automate and control this forced draining.

In addition, the invention also makes it possible to detect the possible clogging of the orifices for evacuation of the clogged liquids and to automate the unclogging of the latter.

Thus, the process according to the invention, by avoiding the complications connected with the presence of large quantities of free-run juices, brings about an optimizing of the yield of press 1 under consideration, particularly for materials to be pressed containing a great deal of free-run juices and after filling of press 1, for example by a closable opening 7 through which materials to be pressed are loaded.

Of course, the invention is not limited to the embodiment described and represented in the accompanying drawings. Modifications are possible, particularly from the viewpoint of the constitution of technical equivalents, without thereby going outside the scope of protection of the invention.

What is claimed is:

1. A process for automatically determining the command and control of a pressurized draining prior to initiating a pressing cycle in a batch press comprising the steps of after filling a press tank with materials to be pressed and before beginning a pressing cycle measuring continuously the flow rate of liquids from the material to be pressed without applying any pressing pressure, rotating the press tank and ascertaining the minimum and maximum values of the flow rate, comparing the ascertained minimum and maximum flow rate values with respective predetermined values, subjecting the materials to be pressed to a preliminary pressurized draining only when at least one of the minimum and maximum flow rates is greater than a respective predetermined value until both minimum and maximum flow rates are lower than their respective predetermined values and simultaneously checking the orifices for discharging of the liquids for clogging, and beginning the pressing cycle after completion of the preliminary pressurized draining.

2. A process according to claim 1 wherein the preliminary pressurized draining of the materials to be pressed is performed only when at least one of the following conditions is ascertained:

$$D_{max} \geqq K_1 \times D_o \text{ or } D_{min} \geqq K_2 \times D_o,$$

where ($K_1$) is a constant whose value is between 0.5 and 2, ($K_2$) is a constant whose value is between 0.05 and 0.4 and where ($D_o$) is a flow rate value determined as a function of the size and the filling rate of the tank of press (1).

3. A process according to claim 1 wherein the preliminary pressurized draining of the materials to be pressed comprises initially removing air contained in the tank of the press, then performing a controlled pressing at low pressure followed by a decompression of the tank.

4. A process according to claim 3 wherein air contained in the tank of the press is driven outside the tank through orifices and at least a drain orifice provided for the evacuation of liquids, said tank being positioned such that said orifices and said drain orifice are located in the upper portion of the tank, air being driven outwardly by the raising of the materials to be pressed in the tank under the action of a pressing element.

5. A process according to claim 3 wherein the controlled pressing at low pressure for the pressurized draining after removal of air contained in the tank of the press comprises applying a first pressing pressure ($P_1$) of a low value for a time ($T_1$) determined as a function of the flow of the liquids, applying a second pressing pressure ($P_2$) of greater intensity than the low pressure ($P_1$) if no clogging of the orifices for evacuation of the liquids has been detected during the low pressure level ($P_1$), subjecting the tank of the press to decompression, and mixing the materials to be pressed after completion of the second pressure level ($P_2$).

6. A process according to claim 5 wherein the second pressure level ($P_2$) is maintained for at least a predetermined time ($T_2$) and beyond the said time ($T_2$) until the flow rate of the extracted liquids falls below a predetermined value ($D_2$) which is a function of ($D_o$).

7. A process according to claim 5 wherein the openings for evacuation of liquids are determined to be clogged when after application of the first pressure ($P_1$) for a time ($T_C$) during a pressurized draining the flow rate of the extracted liquids is less than ($D_o$) while $D_{min} \geqq K_2 \times D_o$ during the phase preceding the application of pressure $P_1$.

8. A process according to claim 5 and the steps of prolonging the application of the first pressure ($P_1$) for a predetermined time ($T_p$) after any clogging has been detected, and then vigorously mixing the materials to be pressed after decompression to disengage the clogged orifices.

* * * * *